United States Patent [19]

Martincic

[11] 4,307,365

[45] Dec. 22, 1981

[54] CURRENT TRANSFORMER

[75] Inventor: Paul W. Martincic, Hermitage Township, Delaware County, Pa.

[73] Assignee: Westinghouse Electric Corp., Pittsburgh, Pa.

[21] Appl. No.: 149,871

[22] Filed: May 14, 1980

Related U.S. Application Data

[62] Division of Ser. No. 873,032, Jan. 27, 1978, Pat. No. 4,225,839.

[51] Int. Cl.[3] ..... H01F 27/04

[52] U.S. Cl. ..... 336/96; 200/44; 336/107; 336/174

[58] Field of Search ..... 336/105, 107, 96, 205, 336/192; 200/44, 51.07, 155 R, 155 A, 302

[56] References Cited

U.S. PATENT DOCUMENTS

| | | | |
|---|---|---|---|
| 3,043,994 | 7/1962 | Anderson et al. | 336/96 X |
| 3,208,021 | 9/1965 | Elliott | 336/107 |
| 3,246,272 | 4/1966 | Wiley | 336/96 X |

*Primary Examiner*—Thomas J. Kozma

*Attorney, Agent, or Firm*—E. L. Pencoske

[57] ABSTRACT

A current transformer is encapsulated in an injection molded layer of insulating material. The current transformer includes a secondary terminal assembly having individual terminals mounted on a terminal board. The terminal board is formed of a material that softens within the normal processing temperature range of the encapsulating material and forms an amalgamation therewith without a distinct interface between the terminal board and the encapsulating material which thereby provides a fluid-tight seal around the terminal assembly. The individual terminals have an intermediate shoulder disposed adjacent the top surface of the terminal board to prevent the molding material from covering the terminal assembly during the injection molding operation and, further, to provide a sealing surface for the molding material around the terminal assembly. A shorting bar is rotatably mounted between the terminals and rotates between a closed position shorting the terminals and an open non-shorting position. A terminal cover interlocks with the shorting bar to prevent improper positioning of the shorting bar.

4 Claims, 9 Drawing Figures

FIG.6
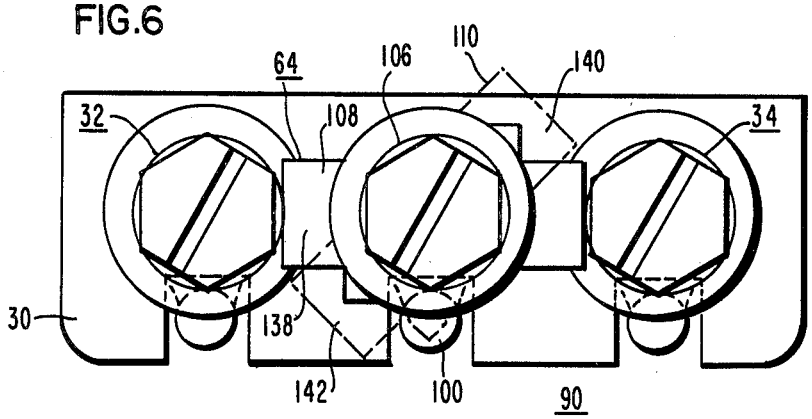
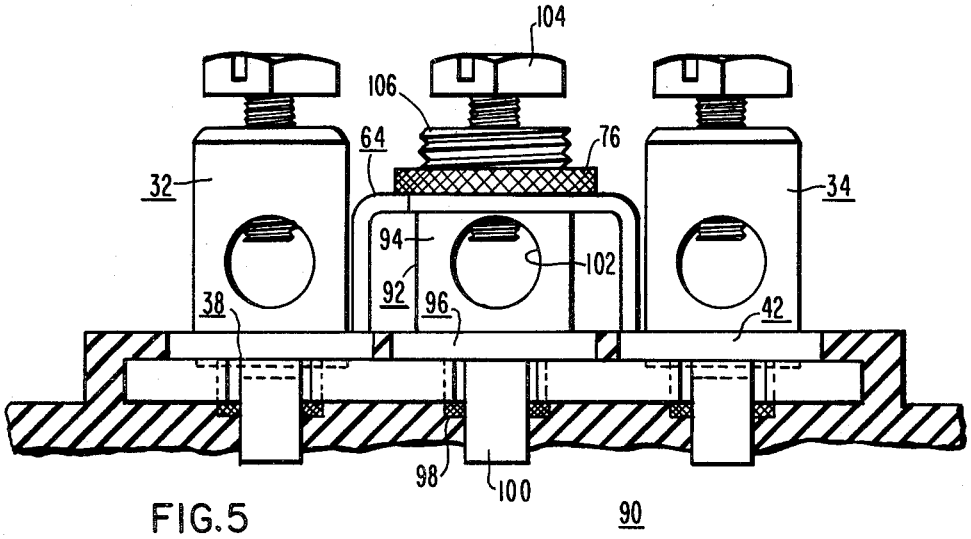
FIG.5

CURRENT TRANSFORMER

This is a divisional of Ser. No. 873,032, now U.S. Pat. No. 4,225,839, filed Jan. 27, 1978,

BACKGROUND OF THE INVENTION

1. Field of the Invention

This invention relates, in general, to electrical apparatus and, more specifically, to instrument transformers, such as current transformers.

2. Description of the Prior Art

In conventional current transformers, it is common practice to encapsulate a magnetic core and coil assembly in a resilient, elastomeric composition, such as butyl rubber or various epoxy resins. Although such materials provide excellent dielectric properties, they have become quite expensive. In addition, the process of molding these types of materials around the current transformers is very time consuming since it generally takes several hours for these materials to cure to a hardened state. Furthermore, with these types of encapsulating materials it has been difficult to provide a fluid-tight seal between the molding material surrounding the core and coil assembly and the secondary terminal assembly which extends through the outer layer of molding material.

It has been proposed to injection mold a layer of insulating material around current transformers. Such a process simplifies the manufacturing operation since the current transformer is encapsulated in a hardened insulating material in a matter of several minutes instead of the several hours required with conventional types of encapsulating processes. Since extremely high pressures are used in the injection molding process, it has heretofore been difficult to prevent the molding material from covering the secondary terminal assembly and, further, it has been impossible to insure an adequate fluid-tight seal between the outer layer of molding material and the secondary terminal assembly.

Thus, it would be desirable to provide an instrument transformer, such as a current transformer, having a unique secondary terminal design which enables the current transformer to be encapsulated in an insulating material through an injection molding process. It would also be desirable to provide a current transformer which has a fluid-tight seal between the molding material and the secondary terminal assembly.

A basic requirement of small instrument transformers, such as current transformers, is the use of a permanently attached shorting bar that will short out the secondary terminals when the current transformer is not in use. The shorting bar must be permanently attached to the current transformer and, further, must short out the two terminals in a conventional current transformer configuration as well as three terminals in the case of a secondary tapped design on a dual voltage current transformer. In addition, the shorting bar should interlock with a terminal cover in order to prevent the cover from being installed if the shorting bar is in the wrong position.

Thus, it would be desirable to provide a secondary terminal assembly for a current transformer which includes an improved shorting bar which is easily adaptable for two and three terminal current transformer configurations. It would also be desirable to provide a secondary terminal assembly for a current transformer having a shorting bar which meets the requirements of permanent attachment to the current transformer as well as providing an interlock feature with the terminal cover.

SUMMARY OF THE INVENTION

Herein disclosed is a current transformer having a unique secondary terminal assembly that enables the current transformer to be encapsulated in an insulating material by an injection molding process without the sealing problems encountered with terminal assemblies used in prior art current transformers. The secondary terminal assembly consists of individual terminals secured to a terminal board. The terminal board is formed of a material which softens within the normal processing temperature range of encapsulating material and forms an amalgamation without a distinct interface between the two materials which provides a fluid-tight seal around the terminal assembly. In addition, the individual terminals include an intermediate shoulder which is disposed adjacent the top surface of the terminal board and serves to prevent the molding material from covering the terminals despite the high pressures involved in the injection molding operation. The shoulder on each individual terminal presents a sealing surface which enables the encapsulating material to form a fluid-tight seal around each individual terminal.

The secondary terminal assembly disclosed herein includes a shorting bar which is rotatably mounted on a center stud disposed between the two terminals in a two-terminal current transformer configuration and on a center terminal in a three-terminal tapped secondary configuration. The shorting bar is rotatable between a closed position shorting all of the individual terminals and an open, non-shorting position. The shorting bar interlocks with a terminal cover to prevent the cover from being placed over the terminal assembly if the shorting bar is in the wrong position with respect to the connection of electric leads to the terminals.

BRIEF DESCRIPTION OF THE DRAWING

Various features, advantages and other uses of this invention will become more apparent by referring to the following detailed description and the accompanying drawing in which:

FIGS. 5 and 6 are orthographic views of a secondary terminal assembly constructed according to another embodiment of this invention.

DESCRIPTION OF THE PREFERRED EMBODIMENTS

Figure 1:
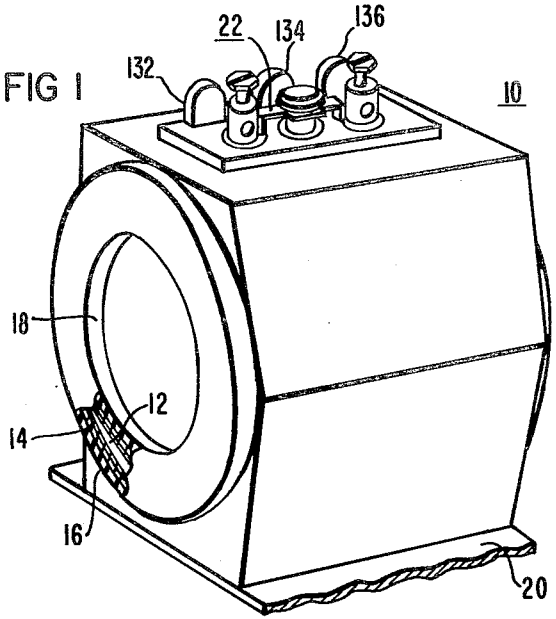
FIG. 1 is a perspective view, partially broken away, of a current transformer constructed according to the teachings of this invention.

Throughout the following description, identical reference numbers refer to the same component shown in all figures of the drawing.

Referring now to the drawing, and to FIG. 1 in particular, there is shown an electrical apparatus 10, such as a current, transformer, constructed according to the teachings of this invention. The current transformer 10 includes a magnetic core 12 which may be of the ring or toroidal type and a secondary winding 12, which is also toroidal in shape and which is inductively coupled to the magnetic core 12. An insulating casing 16, consisting of a thin layer of electrical insulating material, is formed around the magnetic core 12 and secondary winding 14. The current transformer 10 is illustrated as being of the type known in the art as a "through-type." The magnetic core 12 and secondary winding 14 are coaxially disposed with a central opening 18 being formed therein through which an associated primary winding, such as a current carrying conductor, not shown, passes. A mounting plate 20 is securely attached to the bottom of the current transformer 10 to provide a suitable mounting surface therefor. A secondary terminal assembly 22, described in detail hereafter, is illustrated and includes individual terminals which are connected to the ends of the secondary winding 14 and provide the means for connecting the current transformer 10 to an electrical circuit.

According to the preferred embodiment of this invention, the current transformer 10 is encapsulated in the thin layer or casing 16 of insulating material by an injection molding process. In this process, the magnetic core 12 and secondary winding 14, with the secondary terminal assembly 22 connected thereto, are placed in a suitably shaped mold. A thermoplastic, electrically insulating material, such as one sold commercially by the Uniroyal Company under the tradename "TPR" or one sold by the Shell Chemical Company under the tradename "Elexar," is softened in the barrel of the injection molding machine by heat and is, then, injected or shot into the mold under extremely high pressures, ranging from 2,000 to 20,000 psi. The insulating material fills cavity or space between the mold and the current transformer 10 and forms the thin layer 16 of insulating material around the current transformer 10 which is hardened, to a solid state, by water cooling of the mold during the injection molding process.

Figure 4:
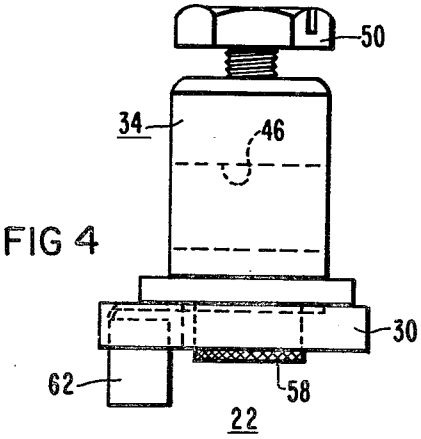
FIGS. 2, 3 and 4 are orthographic views of a secondary terminal assembly constructed according to one embodiment of this invention.
Figure 3:
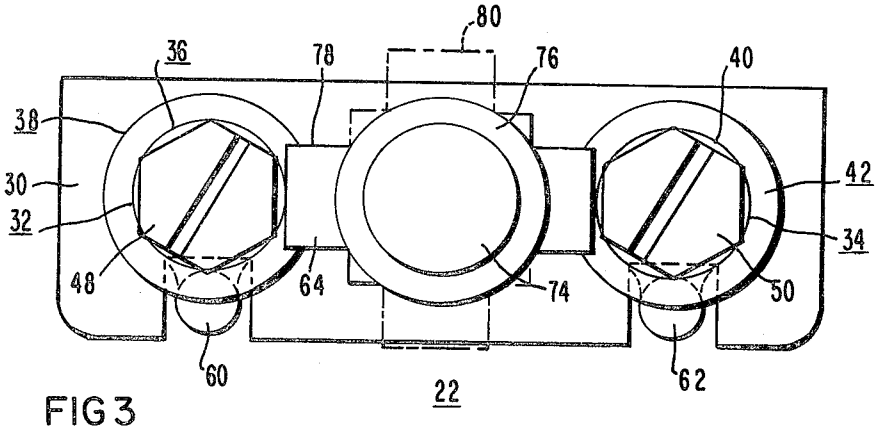
Figure 2:
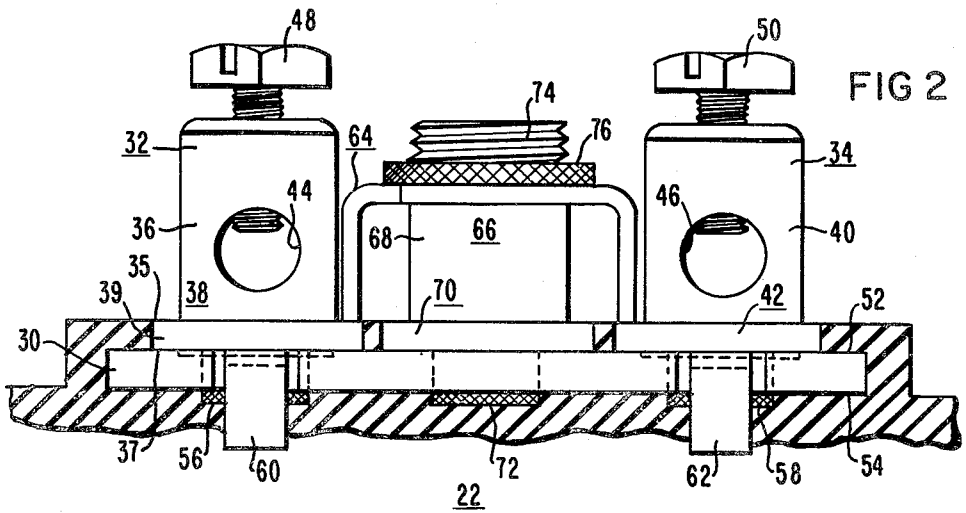

Referring now to FIGS. 2, 3 and 4, there are shown views of the secondary terminal assembly 22 constructed according to one embodiment of this invention. The secondary terminal assembly 22, which provides the means for connecting external leads or cables, not shown, to the secondary winding 14 of the current transformer 10, includes a terminal board 30. The terminal board 30 is formed of material which softens in the normal processing temperature range of the encapsulating material, approximately 400° to 500° C. at the normal pressures encountered in the injection molding process. Since the molding material used in the preferred embodiment of this invention to encapsulate the current transformer 10 is a thermoplastic blend of a partially cured monoolefin copolymer rubber and a polyolefin, such as polypropylene, the terminal board 30 is formed of polypropylene to which glass fibers may be added for additional strength. During the injection molding process, the terminal board 30 softens and amalgamates with the molding material to form a hybrid zone with no distinct interface between the molding material and the terminal board 30 which provides a fluid-tight seal around the secondary terminal assembly 22.

Although the terminal board 30 and the encapsulating material have been depicted as being formed, at least in part, of polypropylene, if will be apparent that other materials, in which the material forming the terminal board softens within the normal processing temperature range of the encapsulating material to form an amalgamation without a distinct interface between the two materials, may be used without departing from the teachings of this invention.

The secondary terminal assembly 22 shown in FIGS. 2, 3 and 4 illustrates a two-terminal configuration wherein first and second terminals 32 and 34 are respectively connected to the ends of the secondary winding 14 of the current transformer 10. The terminals 32 and 34 are identically constructed and are machined to the desired shape from an electrically conductive material that possesses adequate mechanical strength, such as brass. Each terminal 32 and 34 includes a body portion and an intermediate shoulder portion, such as body 36 and shoulder 38 on terminal 32 and body portion 40 and shoulder 42 on terminal 34. The body of each terminal 32 and 34 has an opening 44 and 46, respectively, extending therethrough into which an external electrical conductor or lead, not shown, may be inserted. Suitable clamping means, such as machine screws 48 and 50, extend respectively through the terminals 32 and 34 to clamp the external conductor in the respective opening 44 and 46 and thereby provide a secure connection between the individual terminals 32 and 34 and the external conductors or cables. Electrical connection between the external cables and the individual terminals 32 and 34 of the secondary terminal assembly 22 may also be achieved by wrapping the ends of the cables around the respective screws 48 and 50 of the terminals 32 and 34 or by inserting leads having spade-type connectors on one end thereof around the respective screws 48 and 50.

The shoulder portions of each terminal 32 and 34 are formed of top, bottom and side surfaces, such as top surface 35, bottom surface 37 and side surface 39 on terminal 32. The individual terminals 32 and 34 of the secondary terminal assembly 22 extend through openings in the terminal board 30 with the bottom surfaces of the respective shoulder portions 38 and 42 being disposed in registry with the top surface 52 of the terminal board 30. The terminals 32 and 34 are shaped like rivets and are secured to the terminal board 30 by clinching the lower portions 56 and 58, respectively, thereof such that the lower portions 56 and 58 are secured to the bottom surface 54 of the terminal board 30. Knurling may be provided on the lower portions 56 and 58 of the terminals 32 and 34 in order to prevent the terminals from twisting loose during the operation of the current transformer 10. In addition, crimp-type connections 60 and 62 are provided on the bottom of the individual terminals 32 and 34, respectively, such that the small diameter wires of the secondary winding 14 of the current transformer 10 may be easily and securely attached to the terminals 32 and 34 of the secondary terminal assembly 22.

The current transformer 10 is also provided with a shorting bar 64 which is used to short out the individual terminals whenever the current transformer 10 is not in use. In the two-terminal secondary terminal assembly 22 shown in FIGS. 2, 3 and 4, the shorting bar 64 is rotatably mounted about a center stud 66 which is disposed between the substantially in-line terminals 32 and 34. The central stud 66 is constructed similar to the terminals 32 and 34 and includes a body 68, a shoulder 70 which is disposed in proximity with the top surface 52 of the terminal board 30 and a lower end portion 72 which extends through an opening in the terminal board 30 and is crimped to the bottom surface 54 of the terminal board 30. The upper portion 74 of the central stud 66 is threaded so as to receive a nut 76 which secures the shorting bar 64 in the desired position on the secondary terminal assembly 22. The shorting bar 64 is rotatable about the central stud 66 from a closed position, shown by the solid line indicated by reference number 78 in FIG. 3, wherein the shorting bar 64 engages the respective shoulder portions 38 and 42 of the first and second terminals 32 and 34 so as to electrically connect together or short out the first and second terminals 32 and 34, and an open or non-shorting position, shown in phantom and indicated by reference number 80, wherein the shorting bar 64 is disengaged from or not connected to at least one of the first and second terminals 32 and 34.

Referring now to FIGS. 5 and 6, there is shown a secondary terminal assembly 90 constructed according to another embodiment of this invention. The terminal assembly 90 includes three substantially in-line terminals 32, 34 and 92 which provide connections between a tapped secondary winding of a dual voltage current transformer and external electrical conductors. The terminal assembly 90 is similar to the terminal assembly 22 shown in FIGS. 2, 3 and 4 with the exception that the central stud 66 about which the shorting bar 64 rotates is replaced by another terminal 92 identical to the first and second terminals 32 and 34 described above. Accordingly, the third terminal 92 includes a body 94, a shoulder 96 disposed adjacent the surface of the terminal board 30, a lower portion 98 secured to the bottom surface of the terminal board 30 and a crimp-type connector 100 for connecting the terminal 92 to one of the conductors of the secondary winding of the current transformer. The terminal 92 has an opening 102 extending therethrough for receiving an external conductor or cable, not shown. A suitable clamping means, such as screw 104, extends through the body 94 of the terminal 92 to engage the conductor or cable within the opening 102 and thereby provide secure electrical connection therebetween. As with the central stud 66 shown in FIG. 2, the upper portion 106 of the third terminal 92 is threaded to receive a nut 76 which secures the shorting bar 64 in either a closed or open position.

The shorting bar 64 is rotatable about the central or third terminal 92 from a closed position, as shown by the solid line indicated by reference number 108 in FIG. 6, in which the shorting bar 64 electrically connects and shorts out the first, second and third terminals 32, 34 and 92, respectively, to an open position, shown in phantom and indicated by reference numeral 110, in which the shorting bar 64 is disengaged from both of the first and second terminals 32 and 34, respectively. Since a conductor or cable may be disposed within the opening 102 of the terminal 92, the open position 110 of the shorting bar 64 is disposed at a substantially 45° angle with respect to the horizontal, as viewed in FIG. 6. Suitable stops, not shown, which maintain the shorting bar 64 in the illustrated open position 110 may be formed during the injection molding operation.

Figure 8:
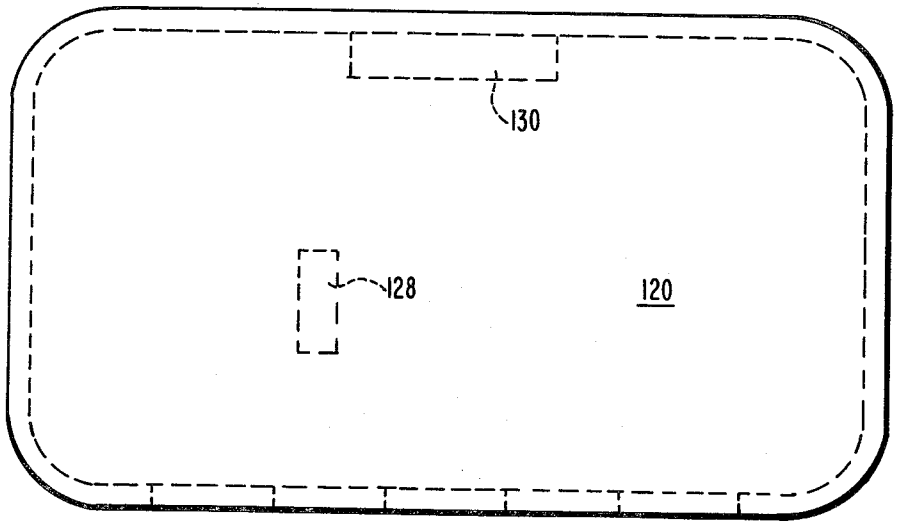
FIGS. 7, 8 and 9 are orthographic views of a terminal cover suitable for use with the aforementioned secondary terminal assemblies.
Figure 7:
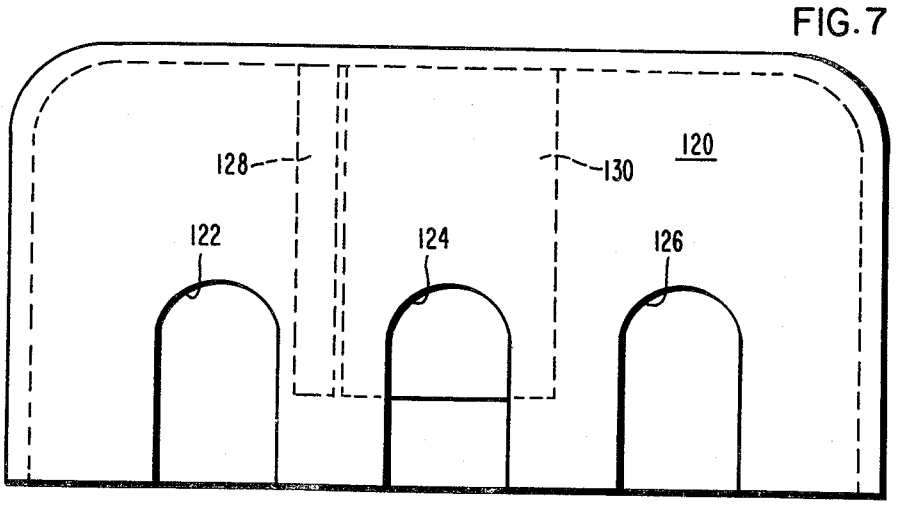
Figure 9:
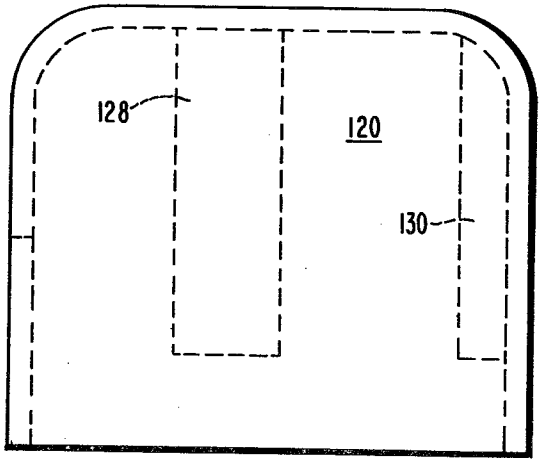

Referring now to FIGS. 7, 8 and 9, there is shown a terminal cover 120 suitable for use with either secondary terminal assembly 22 or 90 described above. The terminal cover 120 is intended to cover and protect the secondary terminal assembly during shipping and operation of the current transformer 10 and, further, to provide a safety interlock feature such that the terminal cover 120 cannot be installed over the secondary terminal assembly if the shorting bar is in the wrong position with respect to the connection of electrical cables to the terminal assembly. The terminal cover 120 includes lead openings 122, 124 and 126 through which the external conductors or cables extend when connected to the individual terminals on the secondary terminal assembly disposed therein.

The safety interlock feature of the terminal cover 120 is provided by finger 128 which extends from the top surface of the terminal cover 20, indentation 130 which is positioned along one side wall of the terminal cover 30 and suitable stops 132, 134 and 136, shown in FIG. 1, which are formed during the injection molding operation and are disposed along one side of the secondary terminal assembly such that the external cables may be inserted from only the other side of the individual terminals. Since the safety interlock feature of the terminal cover 120 is the same for the two-terminal configuration shown in FIG. 3 and the three-terminal configuration shown in FIG. 6, the following description will illustrate the use of the terminal cover 120 with respect to the secondary terminal assembly 90 shown in FIG. 6. In general, the safety interlock feature prevents the terminal cover 120 from being installed over the secondary terminal assembly 90 whenever the shorting bar 64 is in the open or non-shorting position 110 and no external cables are connected to the individual terminals of the secondary terminal assembly 90 and, also, when the shorting bar 64 is in the closed or shorting position 108 and the external cables are connected to the individual terminals of the secondary terminal assembly 90. Thus, with external cables connected to the individual terminals 32, 34 and 92 of the secondary terminal assembly 90 and the terminal cover 120 oriented as shown in FIG. 8, the terminal cover 120 may be installed over the secondary terminal assembly 90 only when the shorting bar 64 is in the open position, as shown by reference number 110 in FIG. 6. If the shorting bar 64 is in the closed position 108 thereby shorting out the three terminals 32, 34 and 92 of the secondary terminal assembly 90, the finger 128 extending from the top surface of the terminal cover 120 will strike the portion of the shorting bar indicated by reference number 138 which prevents the terminal cover 120 from being installed over the secondary terminal assembly 90. Similarly, with no external cables connected to the individual terminals of the secondary terminal assembly 90, the terminal cover 120 should be rotated 180 degrees from the position shown in FIG. 8 such that the cable openings 122, 124 and 126 will be disposed adjacent the stops 132, 134 and 136 on the top of the current transformer 10 thereby preventing any cables from being inserted into the individual terminals. In this orientation, the finger 128 in the terminal housing 120 will strike the portion, indicated by reference number 140, of the shorting bar 64 when the shorting bar 64 is disposed in the open position 110 again preventing the terminal cover 120 from being installed over the secondary terminal assembly 90. At the same time, the indentation 130 on the terminal cover 120 will strike the portion 142 of the shorting bar 64 which also prevents the terminal cover 120 from being installed over the secondary terminal assembly 90. Thus, with no external cables connected to the individual terminals 32, 34 and 92 of the secondary terminal assembly 90, the terminal cover 120 may be installed only if the shorting bar 64 is disposed in the closed position 108 thereby shorting out the terminals 32, 34 and 92 of the secondary terminal assembly 90.

The method or process used to injection mold a layer of encapsulating material around the current transformer 10 will now be described. Initially, the magnetic core 12 having the secondary winding 14 disposed in inductive relation therearound and the secondary terminal assembly connected thereto will be disposed in a suitable mold having an internal cavity of substantially the same configuration as the current transformer 10. An insert member or block is then inserted over the terminals so as to be in registry with the top surfaces of the shoulder portions of the terminals, such as top surface 35 of terminal 32 in FIG. 2. The insert may then be secured to the terminals, such as by screws, to provide a solid connection therebetween. This insert interacts with the shoulder portion of the terminals to prevent the molding material, which is injected under high pressure and temperature, from covering the top surfaces of the shoulders of the individual terminals of the secondary terminal assembly during the injection molding process. A sufficient quantity of electrical insulating material is then injected into the mold under a sufficient pressure, such as 20,000 psi., to fill all of the space between the cavity in the mold and the transformer 10 and, thereby, form a thin layer of molding material around the current transformer 10 disposed therein. Water cooling of the mold is then affected for a sufficient time to cure or solidify the molding material to a hardened state. Under the high pressures and temperatures associated with the injection molding process, the material forming the terminal board 30, softens and forms an amalgamation with the molding material without a distinct interface therebetween which provides a fluid-tight seal around the terminal assembly.

While this invention has been illustrated in combination with a "through-type" current transformer, it will be understood that the unique configuration of the secondary terminal assembly applies equally as well to other types of current transformers where it is desired to injection mold a thin layer of insulating material around such apparatus.

It will be apparent to one skilled in the art that there has been herein disclosed a current transformer which is adapted for encapsulation in a thin layer of insulating material by an injection molding process. The current transformer includes a unique secondary terminal assembly in which the individual terminals are mounted on a terminal board formed of a material that softens the normal processing temperature range of the material used to encapsulate the current transformer. During the injection molding process, the material forming the terminal board softens and forms an amalgamation with the molding material without a distinct interface therebetween which provides a heretofore difficult-to-achieve fluid-tight seal around the terminal assembly. The individual terminals include shoulder portions which are disposed in proximity with the top surface of the terminal board to prevent the molding material, which is injected under high pressure, from covering the terminal assembly and, further, to present a sealing surface such that a fluid-tight seal is formed around each individual terminal. The secondary terminal assembly further includes a shorting bar which rotates between a closed position wherein the shorting bar electrically connects together or shorts out all of the terminals of the secondary terminal assembly, and an open or non-shorting position wherein the shorting bar is disengaged from the individual terminals. The shorting bar interlocks with the terminal cover to prevent improper positioning of the shorting bar with respect to the connection of external electrical conductors to the secondary terminal assembly.

I claim:

1. An instrument current transformer comprising:

a circular magnetic core;

a toroidal secondary winding disposed in inductive relationship around said magnetic core so as to provide a central opening for admitting a primary conductor;

a terminal board having substantially flat top and bottom surfaces;

first, second and third terminals each including an up-standing body having sides extending from a top surface to a lower shoulder portion having top, side and bottom surfaces extending radially outward at the bottom of said body, said body having an opening extending through the sides thereof and an internally threaded hole extending through the body top surface to said opening with said hole threadably receiving a screw member for clamping an external lead conductor either to the terminal top surface or within said opening, and said bottom surface of said shoulder portion having integral rivet means for clamping the shoulder bottom surface to the top of said terminal board and the shoulder bottom surface further having integral wire connection means for connecting to said secondary winding below said terminal board;

said third terminal being mounted on said terminal board substantially midway between said first and second terminals, and said body of said third terminal including an externally threaded portion disposed on the upper portion thereof for treadably receiving a nut member;

an inverted U-shaped shorting bar having a center portion rotatably mounted on the upper portion of said body of said third terminal with the downwardly extending ends thereof being arcuately movable about said last named body between a first position having said bar ends engaging said top surfaces of said shoulder portions of said first and second terminals so that said nut member is effective to clamp said bar ends thereto and a second position having said bar ends disengaged therefrom; and a casing formed of a molded thermoplastic electrical insulating material surrounding said magnetic core, said secondary winding and said terminal board, and being disposed in fluid sealing relation therewith and with the side surfaces of the aforenamed terminal shoulder portions so that said top surfaces thereof are exposed.

2. The instrument transformer of claim 1 wherein the terminal board is formed of a material that softens within the normal processing temperature range of the electrical insulating material so as to form an amalgamation with said electrical insulating material without a distinct interface therebetween.

3. The instrument transformer of claim 2 wherein the electrical insulating material is a thermoplastic blend of a partially cured rubber in admixture with a polyolefin resin and, the terminal board is formed, at least in part, of polypropylene.

4. An instrument transformer comprising:

a circular magnetic core;

a toroidal secondary winding disposed in inductive relationship around said magnetic core;

a terminal board having substantially flat top and bottom surfaces;

first, second and third terminals each including an upstanding body having sides extending between a top surface thereof and a lower shoulder portion having top, side and bottom surfaces extending radially outward at the bottom of said body, said body having an opening extending through the sides thereof and an internally threaded hole extending from the body top surface to said opening for threadably receiving a screw member for clamping an external lead conductor either to said top surface or within said opening, and said bottom surface of said shoulder portion carrying integral rivet means clamping said shoulder portion to said terminal board and further carrying integral wire connection means connected to said secondary winding below said terminal board;

said third terminal including said lower shoulder portion having said top, side and bottom surfaces with said bottom surface mounted on said terminal board between said first and second terminals, and said body of said third terminal including an upper externally threaded portion for threadably receiving a nut member;

an inverted U-shaped shorting bar having a center portion rotatably mounted on the upper portion of said body of said third terminal with the downwardly extending ends thereof being acruately movable about said last named body between a first position having said ends clamped by said nut member to said top surfaces of said shoulder portions of said first and second terminals and a second position having the bar ends disengaged from both of the shoulder top surfaces;

a casing formed of a molded thermoplastic electrical insulating material surrounding said magnetic core, said secondary winding and said terminal board, and being disposed in fluid sealing relation therewith and with the side surfaces of each of the aforenamed shoulder portions so that said top surfaces of the shoulder portions remain exposed; and a terminal cover having a box configuration with a closed top and opposite ends and opposite sides terminating at an open bottom for mounting in first and second positions displaced one hundred and eighty degrees over said first, second and third terminals, one of said sides having lead conductor openings aligned with said first, second and third terminals when said cover is in the second mounted position for receiving external lead conductors connected to said first, second and third terminals, said top and the other of the cover sides including shorting bar interlock means formed by an indentation extending from a middle portion of the other cover side and a finger depending from the cover top at a predetermined location so that when said cover is in the first mounted position and said first, second and third terminals are to have a mutually shorted condition, said finger is positioned so as to be aligned with the space between said first terminal and said third terminal and offset therefrom so that both said finger and said indentation are clear of said first shorting bar position, and concurrently so that both are in interferring relationship with said second shorting bar position, and when said terminal cover is in the second mounted position said finger is positioned so as to be within the space between said second terminal and said third terminal so that said finger is clear of said second shorting bar position and concurrently so that said finger is in interferring relationship with said first shorting bar position.

* * * * *